United States Patent [19]

Kawamura

[11] Patent Number: 4,806,039

[45] Date of Patent: Feb. 21, 1989

[54] CHALK LINER FOR SEWING

[75] Inventor: Munesaburo Kawamura, Tajimi, Japan

[73] Assignee: Kawamuraseichukogyo Co., Ltd., Tajimi, Japan

[21] Appl. No.: 183,346

[22] Filed: Apr. 12, 1988

Related U.S. Application Data

[63] Continuation of Ser. No. 941,102, Dec. 12, 1986, abandoned.

[30] Foreign Application Priority Data

Dec. 24, 1985 [JP] Japan ..... 60-198756[U]

[51] Int. Cl.[4] ..... B05C 19/00

[52] U.S. Cl. ..... 401/208; 401/219; 401/220; 222/325

[58] Field of Search ..... 401/132, 208, 219, 220, 401/137

[56] References Cited

U.S. PATENT DOCUMENTS

| | | | |
|---|---|---|---|
| 852,214 | 4/1907 | Beckmann | 401/208 |
| 2,296,595 | 9/1942 | Booty | 222/325 |
| 3,070,263 | 12/1962 | McMullen | 222/325 |
| 4,062,385 | 12/1977 | Katusha et al. | 222/325 X |

FOREIGN PATENT DOCUMENTS

| | | | |
|---|---|---|---|
| 770951 | 3/1934 | France | 401/208 |
| 432860 | 9/1935 | United Kingdom | 401/208 |

*Primary Examiner*—Richard J. Apley
*Assistant Examiner*—Franklin L. Gubernick
*Attorney, Agent, or Firm*—Cushman, Darby & Cushman

[57] ABSTRACT

A chalk liner has a vessel shaped main body having a chalk chamber to be charged with chalk powder, an opening formed in the lower end of the main body for dropping the chalk powder from the chalk chamber, a gear disposed in the opening for drawing lines on a cloth by the dropped chalk powder, and a cartridge for supplying chalk powder into the main body, which is fittable in the chalk chamber of the main body and detachable therefrom. By installing the cartridge in the main body, the chalk powder previously charged in the cartridge is supplied into the chalk chamber of the main body. When the chalk powder within the main body runs short during the lining operation, the cartridge is detached from the main body and another cartridge which is previously charged with chalk powder is installed in the main body. This enables the easy recharge of chalk powder in a short time.

3 Claims, 2 Drawing Sheets

CHALK LINER FOR SEWING

This is a continuation of application Ser. No. 941,102, filed Dec. 12, 1986, which was abandoned upon the filing hereof.

BACKGROUND OF THE INVENTION

1. Field of the Invention

The present invention relates to a chalk liner for sewing by which lines are drawn on a cloth surface by chalk powder.

2. Description of the Prior Art

When cloth is cut or sewed, lines are previously drawn on the cloth as guides therefor. Formerly, solid chalks were used for this purpose. The solid chalk is formed by solidifying chalk powder with paste into a flat shape such as a triangle and rectangle. The solid chalk is pressed against the cloth surface in its corner portion whereby lines are drawn thereon. However, this solid chalk is gradually worn away while being used. And since the lining operation is performed with the fingers in direct contact with the solid chalk, there occurred drawbacks such as the scattering of the chalk powder and the outbreak of skin diseases.

At present, there are chalk liners free from the above problems having a small opening formed in the lower end of a casing charged with chalk powder, and a gear or a spatula is provided in the opening.

Many improvements have been made in the chalk liners of this type (Japanese Utility Model examined publications Nos. Sho 8-10861, Sho 11-5360, Sho 25-778, and Sho 51-32594). These improvements mainly aim to draw fine clear lines by improving the lower end portion of the chalk liner, by which lines are drawn.

In contrast, the structure for supplying chalk powder into a casing is scarcely improved. In either case, chalk powder is supplied into the casing from an upper opening thereof. However, this method requires a considerably long time for recharging chalk powder. And chalk powder often scatters out of the casing. This results in the operation efficiency becoming low. Accordingly, the conventional chalk liners have been used only once and then thrown away so as to be very uneconomical.

SUMMARY OF THE INVENTION

An object of the present invention is to provide a chalk liner capable of easily recharging chalk powder in a short time.

Another object of the present invention is to provide a chalk liner capable of increasing the sewing efficiency.

The chalk liner of the present invention comprises a vessel shaped main body provided with a chalk chamber to be charged with chalk powder, an opening formed in the lower end of the main body for dropping the chalk powder from the chalk chamber and a gear provided in the opening for drawing lines on a cloth by the dropped chalk powder, and a cartridge for supplying chalk powder into the main body, which is fittable in the chalk chamber of the main body and detachable therefrom. By installing the cartridge in the main body, the chalk powder previously charged in the cartridge is supplied into the chalk chamber of the main body.

When the chalk powder within the main body runs short during the lining operation, the cartridge is detached from the main body and another cartridge which is previously charged with chalk powder is installed in the main body. This results in the chalk liner being easily recharged with chalk powder in a short time.

DETAILED DESCRIPTION OF THE EMBODIMENTS

Figure 1:
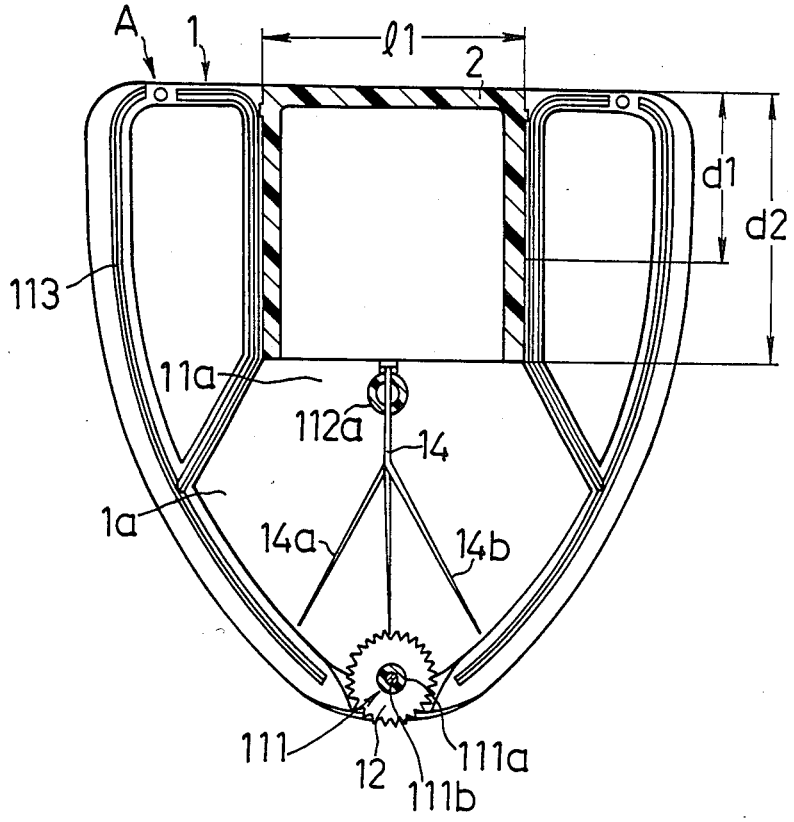
FIG. 1 is a longitudinal sectional view of one embodiment of a chalk liner according to the present invention.
Figure 2:
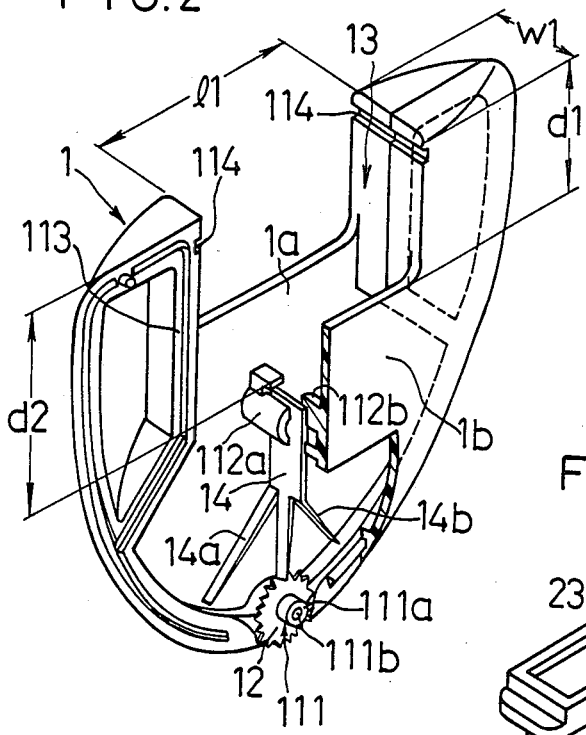
FIG. 2 is a partially cut away perspective view of the main body of the chalk liner shown in FIG. 1.
Figure 3:
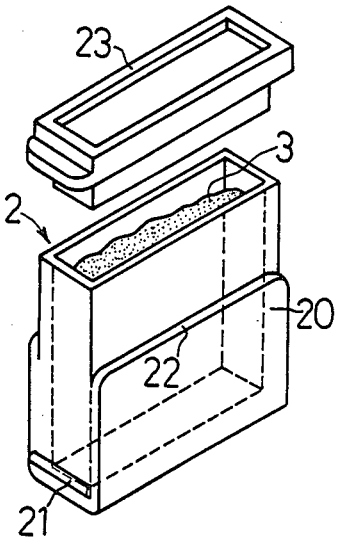
FIG. 3 is a perspective view of a cartridge used in the chalk liner shown in FIG. 1.

Hereinafter, embodiments of a chalk liner according to the present invention will be explained with reference to FIGS. 1 to 3.

A chalk liner for sewing A (hereinafter will be called a chalk liner) is composed of a main body 1 and a cartridge 2.

The main body 1 is made of resin and has a nearly letter D shaped section. The tip end of the main body 1 has a small arc shape. The main body 1 is composed of a pair of opposed side wall members 1*a* and 1*b*, each expanding outward from its peripheral portion to its central portion. The side wall members 1*a* and 1*b* are combined to one body by fitting a rib 113 formed in the outer periphery of the inner surface of the side wall member 1*a* in a groove (not shown) formed in the outer periphery of the inner surface of the side wall member 1*b*. A chalk chamber 11*a* for chalk powder 3 is formed between the lower half portions of the side wall members 1*a* and 1*b*. A shaft 111 is provided between the lower ends of the wall members 1*a* and 1*b*. A gear 12 is axially supported by the shaft 111 so as to be slightly exposed from the lower ends of the side wall members 1*a* and 1*b*.

The shaft 111 is formed by fitting an inner shaft 111*b* projecting from the side wall member 1*b* in an outer shaft 111*a* projecting from the side wall member 1*a*.

The central upper half portions of the side wall members 1*a* and 1*b* define an upward opening cartridge chamber 13 for a cartridge 2. The cartridge chamber 13 has an opening l1 long by w1 wide. And the depth thereof is d1. These dimensions correspond to those of the cartridge 2. Supporting members 112*a* and 112*b* project inwardly from the center of each of the inner surfaces of the side wall members 1*a* and 1*b*, respectively, for supporting the upper end of a spring plate 14 and fixing the cartridge 2 installed in the cartridge chamber 13.

The length (d2) from the supporting members 112*a* and 112*b* to the upper end surface of the main body 1 is equal to the height of the cartridge 2.

The lower end of the spring plate 14 is engaged with the gear 12.

Branch spring pieces 14*a* and 14*b* project from the center of the spring plate 14 rightward and leftward and the tip ends of the branch spring pieces 14*a* and 14*b* extend close to the inner surface of the side walls of the main body 1, respectively.

In each of opposed transverse surfaces of upper portions of the side wall members 1*a* and 1*b*, defining the cartridge chamber 13 is formed a transverse groove 114.

The cartridge 2 is made of resin into a bottomed rectangular prism shaped vessel.

A thick wall portion 20 which is thicker than the other wall portion by the thickness of the side wall member 1*a* or 1*b* is formed in the lower half portion of each of opposed side walls of the cartridge 2. And the upper end of the thick wall portion 20 is formed into a stepped portion 22. The height of the thick wall portion 20 is equal to the depth d1 of the opening of the cartridge chamber 13.

A rib 21 is formed in the lower end portion of each of another opposed side walls of the cartridge 2 to be fitted in the groove 114 formed in the main body 1.

When the cartridge 2 is stored, the cartridge 2 is covered with a cap 23 for previously accommodating the chalk powder 3 and preventing the accommodated chalk powder 3 from scattering before being installed in the main body 1.

Hereinafter the operation of the chalk liner A will be explained. The cap 23 is firstly removed from the cartridge 2 charged with the chalk powder 3. And next, the main body 1 is turned upside down. And the open end of the cartridge 2 is inserted chamber 13 is applied to the cartiride 2 and pushed downward. This results in the stepped portion 22 of the cartridge 2 coming in contact with the end surface of the opening of the main body 1 and the ribs 21 snapping into the grooves 114 and accordingly, the cartridge 2 being installed in the main body. Then, the main body 1 is turned so that the gear 12 is placed downward whereby the chalk powder 3 within the cartridge 2 is supplied into the chalk chamber 11*a*. In operation, the gear 12 is rolled frontward or rearward while being slightly pushed against a disired cloth. At this time, the branch spring pieces 14*a* and 14*b* of the spring plate 14, of which the lower end is engaged with the gear 12, vibrate. These branch spring pieces 14*a* and 14*b* prevent the chalk powder 3 from directly dropping to the gear 12 and operate to drop a proper amount of chalk powder 3 to the gear 12 while pulverizing the chalk powder 3. The dropped chalk powder is received between adjacent teeth of the gear 12 and conveyed in accordance with the turn of the gear 2 while being guided by a V shaped groove opposed to the gear 12. Then, the chalk powder is attached to the surface of the cloth and pressed thereagaist by the gear 12 to form a fine line.

When the chalk powder 3 runs short during use, or when another chalk powder of a different color is desired to be used, another cartridge 2 is installed in the main body 1 as follows. Namely, the main body 1 is firstly turned so that the side wall members 1*a* and 1*b* are nearly horizontal. The cartridge in the main body is quickly extracted. Then another cartridge with its cap 23 removed is inserted open end first into the upper opening in the body and pushed in.

The installation construction of the cartridge 2 is not limited to that of the present embodiment. Another structure wherein the cartridge 2 is inserted from the side surface of the main body 1 can be adopted. In this case, the structure is such that the cap is slidable relative to the cartridge in the direction of the side of the main body thus when a cartridge provided with such a cap as described above is inserted, the cap is made to come in contact with the outer surface of a side wall or the like, so that as the cartridge is inserted, the cap is gradually slid therefrom.

The shape of the cartridge and the cartridge chamber and the installation construction thereof can be modified without departing from the spirit or the scope of the present invention.

As described above, the chalk liner according to the present invention is provided with a replaceable cartridge for recharging chalk powder. The chalk liner according to the present invention enables the recharge of chalk powder without a long time interruption of a lining operation when the chalk powder within the chalk liner runs short, or when the color of the chalk powder is desired to be changed. This results in the operation efficiency being improved.

Further, in the chalk liner of the present invention, the chalk powder is not scattered when the chalk powder is recharged, and accordingly the chalk powder is prevented from being attached to undesired places on the surface of the cloth.

What is claimed is:

1. A chalk liner for sewing comprising:

a vessel shaped main body having a lower tip, a chamber to which chalk powder is supplied, an upper opening through which chalk powder is supplied to said chamber, and a lower opening at said tip through which chalk powder is dispensed, said main body comprising a pair of letter-D shaped opposed side walls, the straight peripheral portions of said walls being uppermost and the arcuate peripheral portions of said walls converging and being secured together except at said lower tip to define said lower opening, each said wall having a rectangular notch centrally in said straight peripheral portion thereof, and transverse wall portions connecting the sides of each said notch with corresponding sides of the other notch, said upper opening being defined by said transverse wall portions and the bottom edges of said notches, each of said transverse wall portions being provided with a transversely extending groove near an upper end thereof;

a gear rotatably disposed in said lower opening with a portion of said gear extending out of said lower opening for drawing lines on a cloth surface by dispensed chalk powder; and a cartridge for holding and supplying chalk powder to said chamber, said cartridge comprising a rectangular prism-shaped vessel having opposed side walls, opposed transverse walls, a bottom and an open end opposite said bottom, a removable closure for said open end, a step facing said open end on the exterior of each of said cartridge side walls, a transversely extending rib on the exterior of each of said cartridge transverse walls fittable in the corresponding transversely extending groove in said body transverse wall portions when said cartridge is installed in said main body, that portion of said cartridge between said steps and said bottom being complementary to said notches and said body transverse wall portions, whereby when said cartridge is inserted end opening first into said upper opening, said ribs fit into said transversely extending grooves and said steps engage said notch bottom edges and chalk powder is supplied from said cartridge to said chamber without exterior scattering.

2. The chalk liner according to claim 1 wherein the cartridge is installed in the main body by inverting said main body and fitting said upper opening thereof over the open end of said cartridge.

3. The chalk liner according to claim 1 wherein one of said body side walls has a groove extending along the inner side of the peripheral edge portion thereof and fitting in a complementary groove in the other of said body side walls.

* * * * *